US005889264A

United States Patent [19]

Kidblad et al.

[11] Patent Number: 5,889,264

[45] Date of Patent: Mar. 30, 1999

[54] MICROWAVE FOOD BOILING CONTROLLED WITH SENSORS

[75] Inventors: Birgitta Kidblad; Per Torngren, both of Norrkoping, Sweden

[73] Assignee: Whirlpool Corporation, Benton Harbor, Mich.

[21] Appl. No.: 866,365

[22] Filed: May 30, 1997

[30] Foreign Application Priority Data

May 31, 1996 [SE] Sweden ..... 9602159

[51] Int. Cl.[6] ..... H05B 6/68

[52] U.S. Cl. ..... 219/707; 219/705; 219/716; 99/325

[58] Field of Search ..... 219/707, 705, 219/704, 703, 719, 715, 716, 718; 99/325

[56] References Cited

U.S. PATENT DOCUMENTS

| | | | |
|---|---|---|---|
| 4,376,131 | 3/1983 | Mori et al. | 219/705 |
| 4,401,884 | 8/1983 | Kusunoki et al. | 219/492 |
| 4,506,127 | 3/1985 | Satoh | 219/718 |
| 4,864,088 | 9/1989 | Hiejima et al. | 219/707 |
| 4,874,928 | 10/1989 | Kasai | 219/707 |
| 5,530,229 | 6/1996 | Gong et al. | 219/719 |

FOREIGN PATENT DOCUMENTS

| | | |
|---|---|---|
| 0493266A2 | 7/1992 | European Pat. Off. . |
| 0688146A2 | 12/1995 | European Pat. Off. . |
| 0701387A2 | 3/1996 | European Pat. Off. . |

*Primary Examiner*—Philip H. Leung
*Attorney, Agent, or Firm*—Robert O. Rice; Stephen D. Krefman; Joel M. Van Winkle

[57] ABSTRACT

Method and microwave oven for controlled boiling of a foodpiece. The foodpiece is heated rapidly into reliable boiling by a supply of maximum microwave power, thereafter a desirable degree of boiling ($H_{eb}$) is carried out during a predetermined boiling time ($T_b$) while controlling the supplied microwave power level dependent on feed-back information (HUM) from a sensor. The boiling procedure is carried out fully automatically with consequently increased user security, decreased energy consumption and improved boiling quality.

17 Claims, 4 Drawing Sheets

MICROWAVE FOOD BOILING CONTROLLED WITH SENSORS

BACKGROUND OF THE INVENTION

1. Technical Field

This invention relates to a method at a microwave oven for controlling a boiling procedure, said oven comprising an oven cavity, a microwave source, a supply system for supplying microwaves into the cavity, a control unit for controlling power level and supply time of the microwaves supplied to the cavity, and means connected to said control unit for setting or calculating a boiling time of a solid or liquid type of foodpiece. The invention is also directed to a microwave oven, a microwave heating device and the use thereof for automatically performing a boiling procedure.

2. Technical Background and Prior Art

Prior art is represented by U.S. Pat. No. 4,791,263, disclosing a method of the kind mentioned in the introduction, in which heating starts with 70% of maximum power and proceeds until a gas sensor senses 65% change of an initial value. Based on the time used for reaching this value a time for continued heating is calculated, said heating proceeding at about 50% of said maximum power. At the end of this calculated time it is assumed that boiling has been achieved, being thereafter continued during two optional, fixed times at a power level which is predetermined. Thereafter the method proceeds to a keep-warm state at a further lower, fixed power level. From this is clear that the power level during the actual boiling is controlled in a so called "open loop" by the use of fixed times and fixed power levels.

The disclosed method has the drawback that maximum power is not used when starting the procedure thereby increasing the consumption of time, said drawback being of the same kind as shown by a generally known method, which means setting a power level of ¾ of maximum power for example and heating during a predetermined amount of time. A further disadvantage is that the actual boiling takes place at a predetermined, fixed power level without sensing the progress of the procedure. This means that the food piece may be directly influenced by the microwaves to an extent which is too high, giving a consequent risk of overboiling, which furthermore means unnecessary consumption of energy.

SHORT DESCRIPTION OF THE INVENTION

One object of invention is to obtain a method for controlled boiling in a microwave oven or heating device not showing the above mentioned drawbacks and allowing a boiling procedure which is more adapted to the individual foodpiece.

A further object of invention is to obtain a microwave oven or microwave heating device for implementing said method.

Still further objects of invention are to obtain a method and an oven improving security at boiling and improving the user friendliness of the oven.

The first mentioned object is obtained by a method of the kind mentioned in the introduction, which is characterized by supplying the microwaves of maximum or substantially maximum power during a first heating step for heating the foodpiece rapidly into boiling;

sensing a first parameter indicating the entering into boiling of the foodpiece by means of a first sensor;

continuing thereafter the procedure by a second sensor controlled heating step, during which simmering or boiling is maintained at a desirable level during the boiling time dependent on feedback information, in which measuring of the boiling time ($T_b$) is started the supplied power level is controlled dependent on the output signal from a second sensor for sensing a second parameter indicating said desirable degree of continuous simmering or boiling;

ending the procedure by interrupting the microwave supply when said set boiling time is reached.

Due to the fact that the supplied microwave power during the actual boiling procedure takes place in a "closed loop" based on feedback information from said sensor, a continuously going on adaption of the supplied microwave power is obtained to a level which is required momentarily for maintaining boiling. Thereby an improved quality of the boiled foodpiece is obtained and the risk of over-boiling is eliminated. At the same time, by continuously adapting the necessary power level, a decreased energy consumption is obtained. The boiling time is made shorter by the use of a power level which is as high as possible until entering into boiling.

According to a preferred embodiment of the invented method said first heating step is interrupted when said first parameter reaches a predetermined value indicating reliable boiling, and by controlling the power level by sensing said second parameter periodically and comparing the same with an empirically established value which corresponds to a desirable degree of simmering/boiling. The use of both of said values facilitates the design of a boiling procedure control program and secures a boiling result of good quality.

One further preferred embodiment of the method is based on sensing of the humidity in the cavity by means of one or several humidity sensors, and is characterized by the fact that the power control is based on a humidity mean value which is calculated continuously on the basis of a predetermined number of the humidity values which have been sensed most recently. This improves the power control accuracy by eliminating the influence from instantaneous humidity variations.

A microwave oven according to the invention comprises an oven cavity, a microwave source, a supply system for supplying microwaves into the cavity, a program controlled microprocessor control unit for controlling power level and supply time of the microwaves which are supplied to the cavity, a humidity sensor which is arranged for sensing the humidity of the ventilation air from the cavity and being conntected to said control unit, as well as operation means which are connected to said control unit for setting a boiling time of a solid or liquid foodpiece, said oven having the features which are evident from the following claim 9.

Preferred embodiments of the method and the microwave oven according to the invention which improve the security of handling are characterized, in the first case, by the fact that said first heating step is interrupted if said predetermined value, and thereby boiling, is not reached within a predetermined time from start, thereby eliminating the risk of damaging the oven, the foodpiece and boiling vessel, for example due to the fact that the supply of a required volume of water has been neglected, the use of a too tight-fitting lid, or of a different reason, and in a second case by the fact that the second heating step is interrupted if said second parameter is continuously lower than said empirically decided value and the difference is greater than a predetermined amount during a predetermined time interval, thereby eliminating risk of dry-boiling after having consumed the supplied water volume.

A microwave heating device according to the invention comprises a heating cavity for heating a solid or liquid type of a foodpiece, a microwave source, a system for the supply of microwaves into said cavity, a control unit for controlling power level and supply time of the microwaves which are supplied to the cavity, means for calculating a boiling time of the foodpiece, and a sensor for sensing a parameter indicating boiling of said food-piece, and shows the features that said control unit is arranged to maintain, after having reached boiling, a desirable degree of continued boiling by controlling the microwave power which is supplied dependent on feedback information from said sensor, said desirable degree of boiling corresponding to an empirically decided target value of said parameter, said power level being incrementally adjusted in small steps dependent on differences that are sensed between said parameter values and said target value, said boiling being interrupted when reaching a calculated boiling time. Said small power level steps have preferably such a low amplitude that a substantially continuous power level control is obtained. The boiling is continued during an automatically calculated boiling time, which for example, may be calculated based on the growth rate of said parameter and the time until boiling is entered into, possibly using supplementary information from a weight sensor for sensing the weight of the foodpiece. This solution means that handling is further facilitated due to the fact that it is not necessary to select the boiling time on an integral operation panel. Occasionally, the heating device may as well comprise means for the selection of a desirable boiling time in order to achieve a freedom of choice in this respect.

Further embodiments are evident from the following claims.

The invention is based on the recognition that it is possible to obtain a substantially improved quality of the foodpiece which is boiled by starting measuring the boiling time when boiling starts and by controlling the microwave power during the boiling time. Further the recognition that this may be obtained by means of an adequately designed control program, which may be implemented by means of the microprocessor based control unit being normally an integral part of a microwave oven and by the use of one or several sensors of a type which is well-known.

DESCRIPTION OF DRAWINGS

The invention will be more closely described in the following in relation to a non-limiting embodiment of the control method according to the invention and a microwave oven for implementing the same by reference to the drawings, in which.

DESCRIPTION OF THE PREFERRED EMBODIMENT

Figure 1:
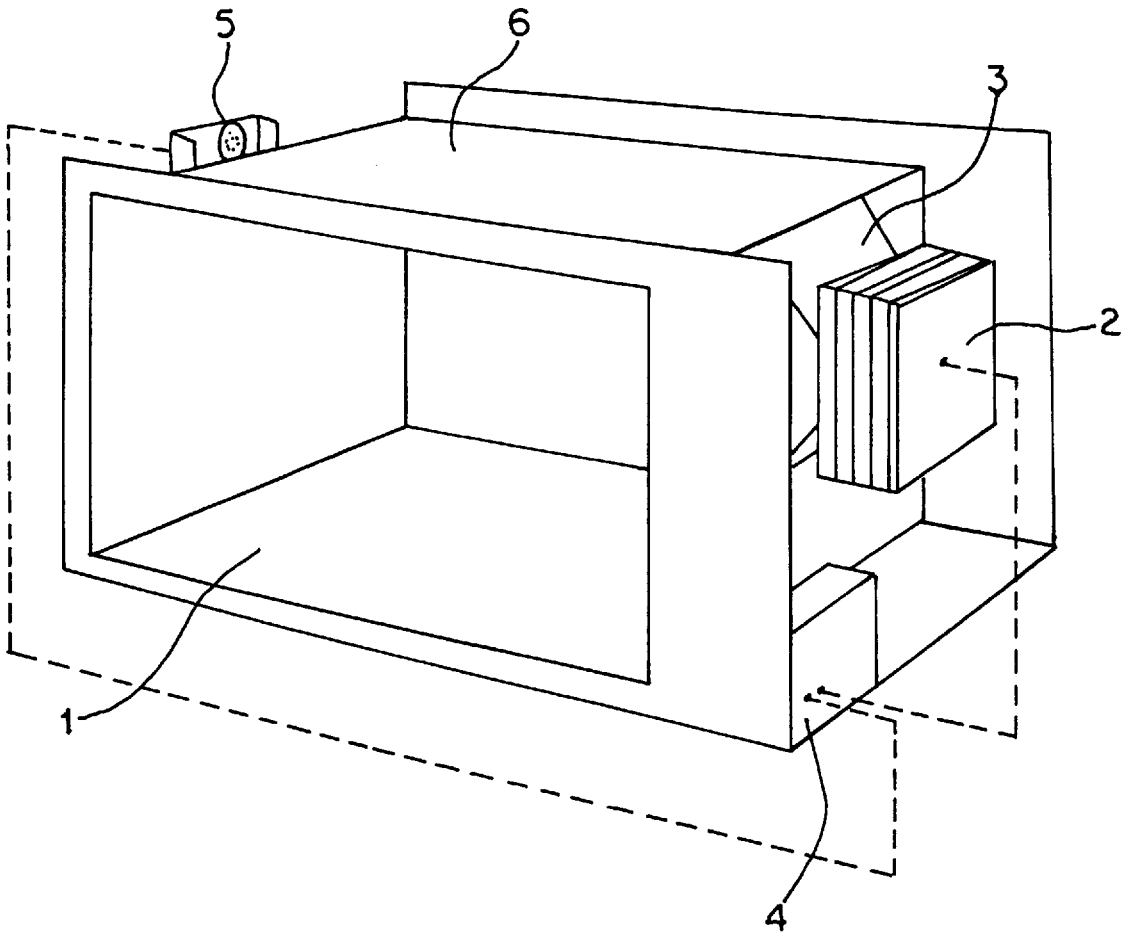
FIG. 1 schematically discloses actual parts of a microwave oven according to the invention.

FIG. 1 discloses invention-related parts of a microwave oven according to the invention, comprising an oven cavity 1, a microwave source 2, a supply system 3 for supplying microwaves from said microwave source to said cavity, a microprocessor based control unit 4 for the control of optional, stored boiling programs dependent on information supplied via the operation panel of the oven (not disclosed), and a humidity sensor 5 arranged in the ventilation air path from the cavity for sensing the humidity of the ventilation air. Dependent on the design of the ventilation air path the humidity sensor 5 may be positioned differently. For the sake of simplicity the connections between the humidity sensor 5, the microwave source 2 and the control unit 4 has been indicated by means of dotted lines. In FIG. 1 the cover of the oven including the operation panel and the oven door for closing the cavity have been eliminated. The more detailed mechanical and electrical design of the oven is not of importance for a disclosure of the invention and has accordingly been left out in this context. Instead one skilled in the art may be referred to the Whirlpool microwave oven of type AVM215, being manufactured and sold by the Applicant. This oven is provided with a grill element and has the following technical specifications: supply voltage 240 V/50 Hz; power consumption 2850 W; microwave power 1000 W; grill element power 1200 W; electronic timer; external dimensions 330×553×477 mm; cavity dimension 227×375×395 mm; microwave power levels that may be selected by means of a control program.

In the disclosed embodiment of the microwave oven according to the invention the supplied microwave power is controlled by so called pulsing of the microwave source 2, being usually a magnetron, meaning that the power supply is subdivided into power cycles and that the magnetron is activated at maximum power level during a optional portion ton of the total cycle time $T_c$, the power level being obtained as the power mean value during the cycle. This type of power control has been used in the oven mentioned above. It may be understood that the invented method may be used as well for a different kind of microwave power control, for example of switch-mode type, presuming however that the power supply may be subdivided into power cycles of an adquate length.

Figure 2:
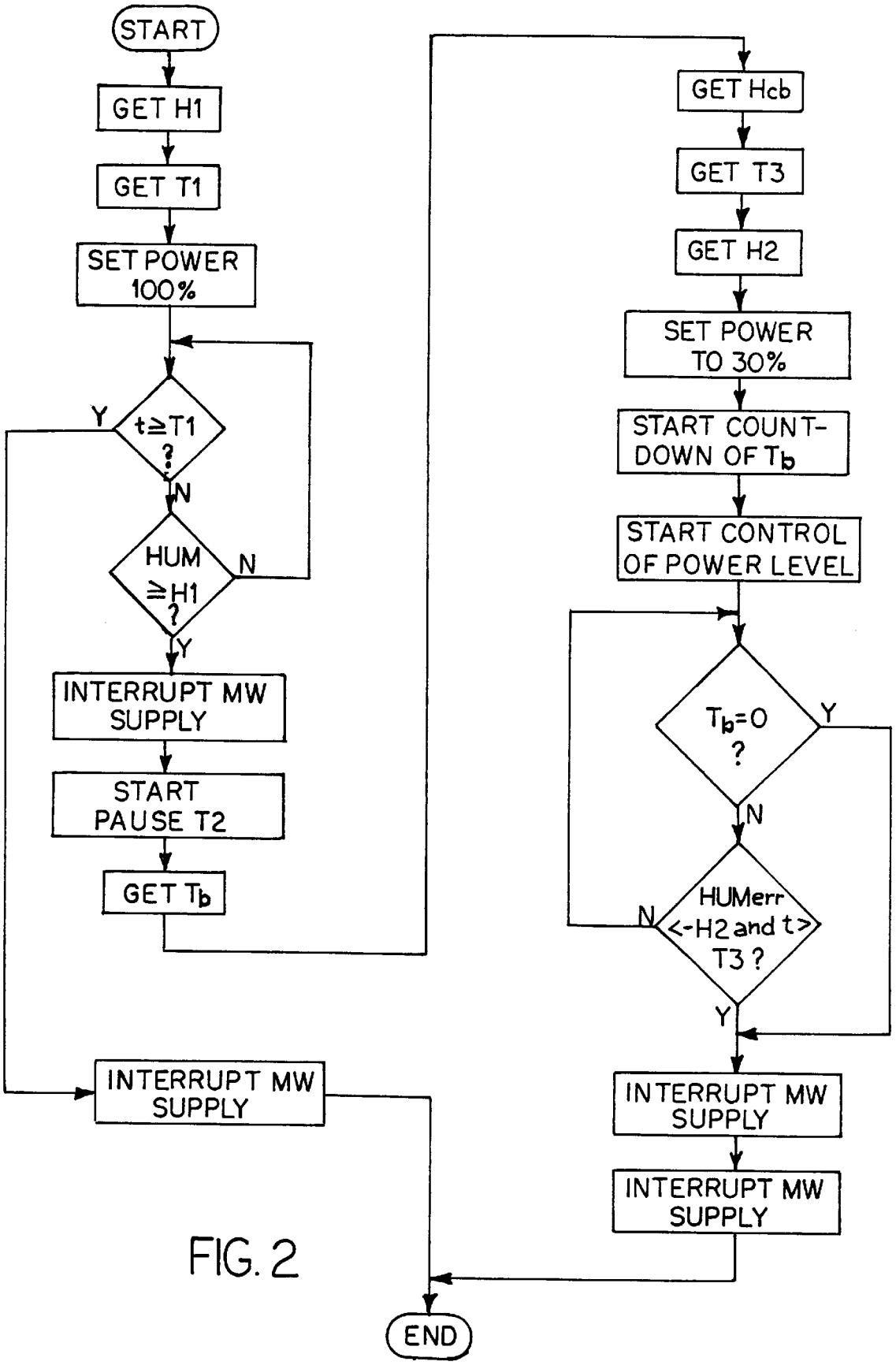
FIG. 2 discloses a flowdiagram of a control program for controlled boiling according to the invention.

The flowdiagram in FIG. 2 illustrates the different steps when carrying the boiling control program according to the invention. Not more than two measures are required by the user, namely: input of a relevant boiling time via the oven operation panel; start of the oven. Thereafter the boiling procedure is carried out and finalized fully automatically. During carrying out of the program a number of constants having empirically decided values are picked up from the memory by the microprocessor. These constants are the following:

| | | |
|---|---|---|
| H1 | = | humidity value indicating reliable boiling. |
| T1 | = | safetytime limit within which H1 shall have been obtained. The procedure is interrupted unless H1 is not obtained within T1 |
| T2 | = | pause interval between the initial boiling-up and the continued, actual boiling |
| $T_b$ | = | selected boiling time |
| $H_{cb}$ | = | emperically settled humidity value corresponding to a desirable degree of continuous boiling |
| $HUM_{av}$ | = | calculated humidity mean value |
| $HUM_{err}$ | = | $HUM_{av} - H_{cb}$ |
| H2 | = | maximum permissible negative value of $HUM_{err}$ during a limited period of time |
| T3 | = | longest period of time during which $HUM_{err}$ is allowed to be lower than −H2. The procedure is interrupted if T3 is exceeded |
| C1, C2, C3, C4, C5 | = | limit values of the difference $HUM_{err} - H_{cb}$, in which |

-continued

| | | |
|---|---|---|
| C1 | = | maximum allowable positive limit, |
| C2 | = | first negative difference limit, |
| C3 | = | second negative difference limit, in which C3 > C2, |
| C4 | = | first positive difference limit, |
| C5 | = | second positive difference limit, in which C4 < C5 < C1 |

In the following t designates running time and HUM designates a humidity value which is sensed.

The program of FIG. 2 starts with step S, runs through steps a1–a18, and ends with step E according to the following:

| | |
|---|---|
| S: | start of boiling program |
| a1: | get H1, go to a2 |
| a2: | get T1, go to a3 |
| a3: | set power level to 100% of maximum microwave power, go to a4 |
| a4: | t ≧ T1?<br>if "yes" (Y), go to a5<br>if "no" (N), go to a6 |
| a5: | interrupt microwave supply, go to E, end program |
| a6: | HUM ≧ H1?<br>if "yes" (Y), go to a7<br>if "no" (N), return to a4 |
| a7: | interrupt microwave supply, go to a8 |
| a8: | start pause interval of length T2, go to a9 |
| a9: | get selected boiling time $T_b$, go to a10 |
| a10: | get $H_{cb}$, go to a11 |
| a11: | get T3, go to a12 |
| a12: | get H2, go to a13 |
| a13: | set power lever to 30% of maximum microwave power, to to a14 |
| a14: | start count-down of $T_b$, go to a15 |
| a15: | start control of power level for maintaining desirable degree of boiling, go to a16 |
| a16: | $T_b = 0$?<br>if "yes" (Y), go to a17<br>if "no" (N), go to a18 |
| a17: | interrupt microwave supply, go to a19 |
| a18: | $HUM_{err} < -H2$ and t > T3?<br>if "yes" (Y), go to a17<br>if "no" (N), return to a16 |
| a19: | interrupt microwave supply, go to E |
| E: | end program |

Figure 3:
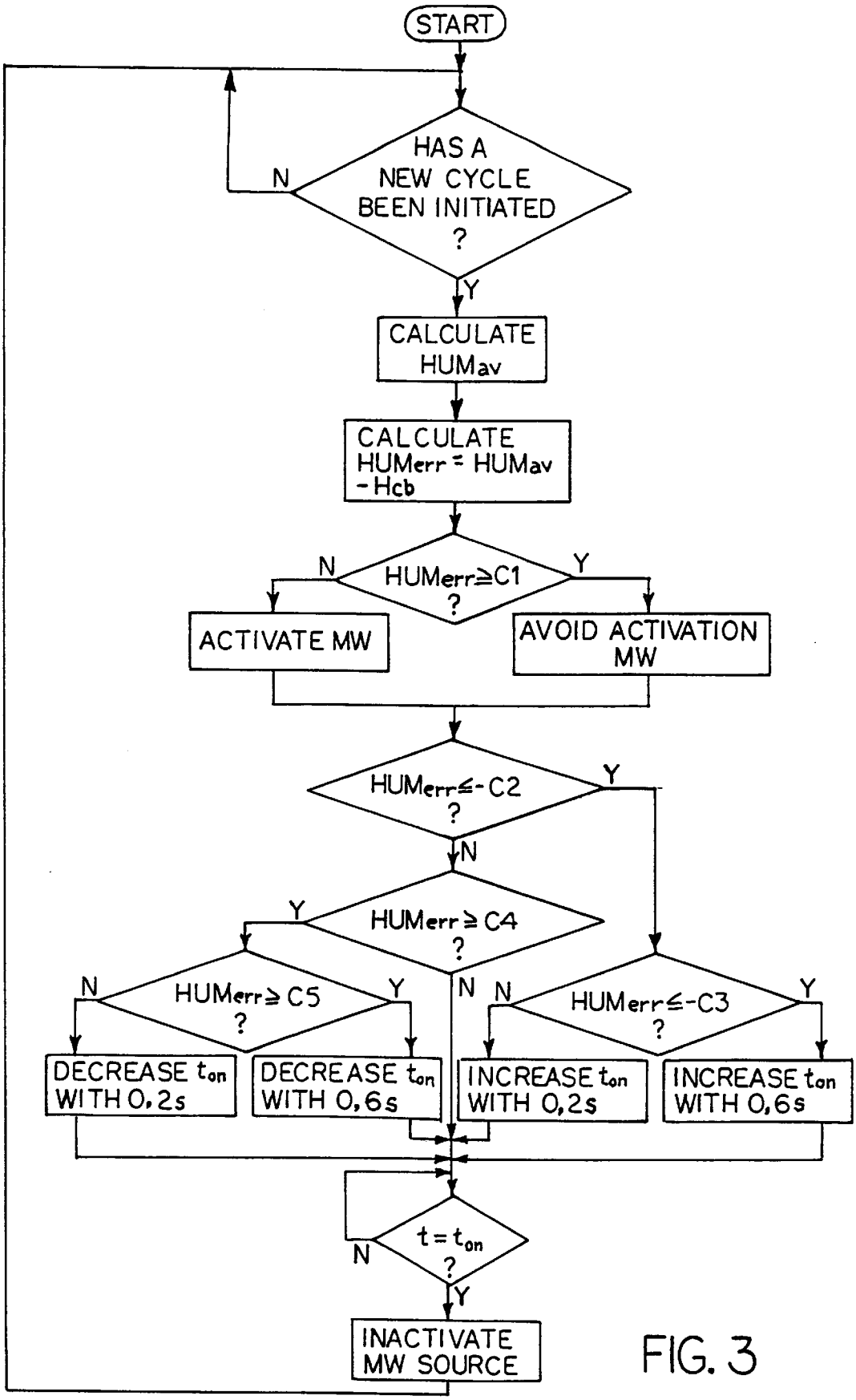
FIG. 3 discloses a flowdiagram of a control program for controlling the power level, being included in the control program according to FIG. 2.

Step a15 means carrying out the control program for controlling the microwave power level which is supplied in order to maintain a desirable degree of boiling, this state being represented by said empirically established humidity value HCb, according to the flowdiagram of FIG. 3. The program comprises steps Sec and b1–b16 and is carried out during each individual power cycle, having in this embodiment a length of about 20 s. From a principle point of view each new cycle is initiated with said microwave source inactivated. A new value of $t_{on}$, which is generated by the power control during a running cycle, is used as an initial value of $t_{on}$ during a nextcoming cycle. At the start of the program the constants C1–C5 which have been defined above are collected, which is not disclosed in the flowdiagram. The program is run through according to the following:

| | |
|---|---|
| $S_{ec}$: | start power level control, go to b1 |
| b1: | has a new power cycle been initiated?<br>if "yes" (Y), go to b2<br>if "no" (N), return to b1 |
| b2: | calculate $HUM_{av}$ according to subroutine (FIG. 4), go to b3 |
| b3: | calculate $HUM_{err} = HUM_{av} - H_{cb}$, go to b4 |
| b4: | $HUM_{err}$ ≧ C1?<br>if "yes" (Y), go to b5<br>if "no" (N), go to b6 |
| b5: | avoid activation of the microwave source, go to b7 |
| b6: | activate the microwave source, go to b7 |
| b7: | $HUM_{err}$ ≦ −C2?<br>if "yes" (Y), go to b8<br>if "no" (N), go to b11 |
| b8: | $HUM_{err}$ ≦ −C3?<br>if "yes" (Y), go to b9<br>if "no" (N), go to b10 |
| b9: | increase $t_{on}$ with 0, 6 s, go to b15 |
| b10: | increase $t_{on}$ with 0, 2 s, go to b15 |
| b11: | $HUM_{err}$ ≧ C4?<br>if "yes" (Y), go to b12<br>if "no" (N), go to b15 |
| b12: | $HUM_{err}$ ≧ C5?<br>if "yes" (Y), go to b13<br>vid "no" (N), go to b14 |
| b13: | decrease $t_{on}$ with 0, 6 s, go to b15 |
| b14: | decrease $t_{on}$ with 0, 2 s, go to b15 |
| b15: | $t = t_{on}$?<br>if "yes" (Y) , go to b16<br>if "no" (N), return to b15 |
| b16: | inactivate the microwave source during the remaining part of the power cycle, return to $S_{ec}$ |

Figure 4:
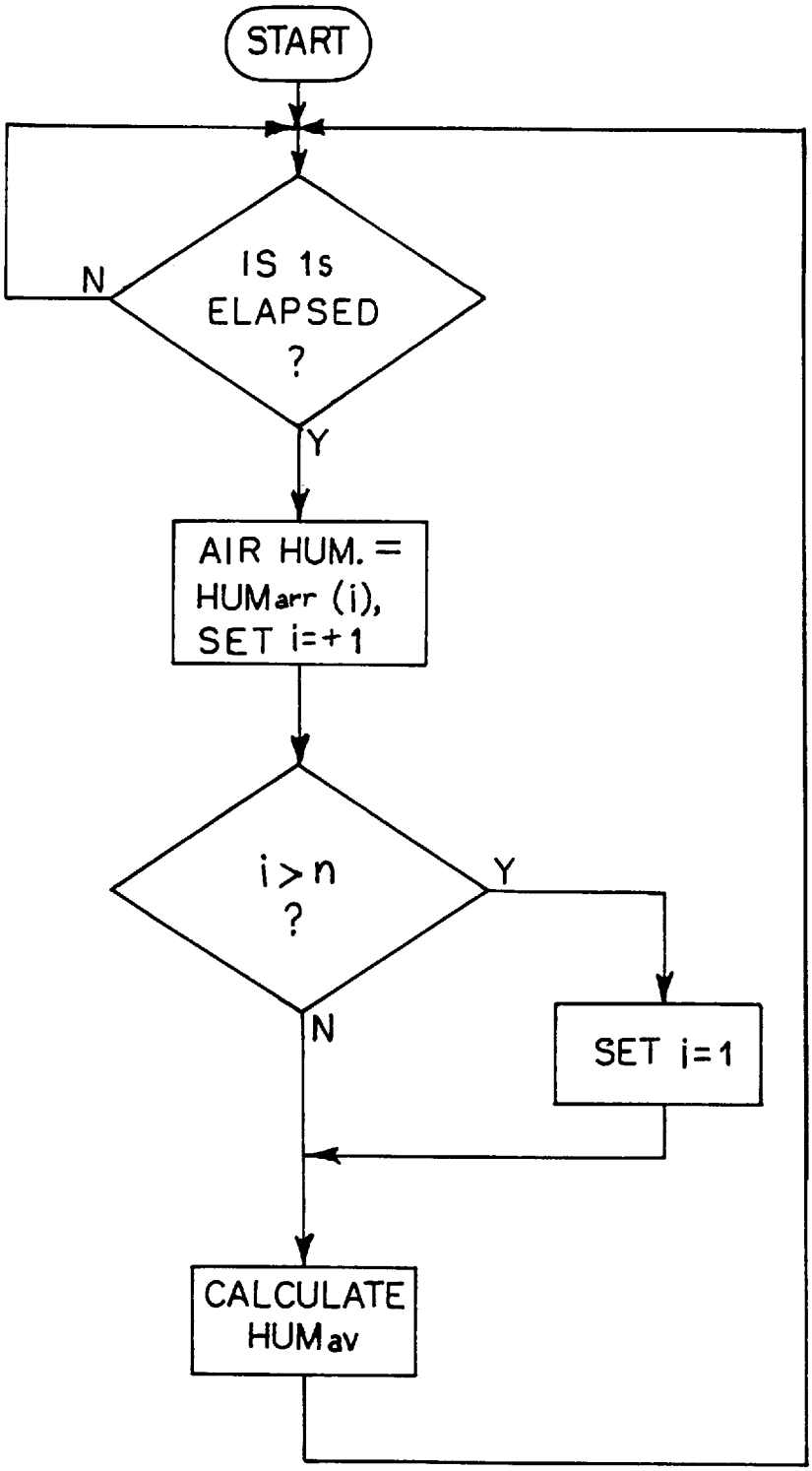
FIG. 4 discloses a flowdiagram of a control program for calculating an air humidity mean value, being a part of the control program as disclosed in FIG. 3.

The flowdiagram of FIG. 4 illustrates a program routine for calculating the air humidity average $HUM_{av}$. In this embodiment this calculation is carried out once per second, which means 20 calculations during the power cycle of length 20 seconds which is used. Each second the control unit will receive a new humidity sample from the humidity sensor 5. Calculation of said average is based on n such samples, in which n=20 applies in this case. In the flowdiagram $HUM_{arr}(i)$ is used to designate the i:th sample which is sensed. The program comprises steps $S_{hav}$ and c1–c5, and is carried out according to the following:

| | |
|---|---|
| $S_{hav}$: | start program for calculating the air humidity average, go to c1 |
| c1: | is 1s elapsed?<br>if "yes" (Y), go to c2<br>if "no" (N), return to c1 |
| c2: | air humidity = $HUM_{arr}(i)$, set i = +1, go to c3 |
| c3: | i > n?<br>if "yes" (Y), go to c4<br>if "no" (N), go to c5 |
| c4: | set i = 1, go to c5 |
| c5: | calculate $HUM_{av} = \sum_{i=1}^{n} HUM_{arr}(i)/n$, return to c1 |

Comparative tests of boiling in a microwave oven according to prior art (constant power level during boiling time) and a microwave oven according to the invention using power level control during boiling have generally proved a significantly lower energy consumption and improved quality of the foodpiece which is boiled when using the oven according to the invention. Boiling of 500 g of sliced carrots in a prior art oven accordingly requires a total of 123 kJ and results in partly shrivelled and dried carrot slices, to be compared with the energy consumption of 74 kJ and a superior quality when using the oven according to the invention.

We claim:

1. A method for boiling in a microwave oven, said oven comprising an oven cavity, a microwave source, a supply system for supplying microwaves into the cavity, a control unit for controlling power level and supply time of the microwaves which are supplied to the cavity, and operation means connected to said control unit for setting a boiling time ($T_B$) for a solid or liquid type of foodpiece, the method comprising:

supplying microwaves of substantially maximum power during a first heating step for rapid heating of the foodpiece into boiling;

sensing the humidity which is indicative of the condition of the foodpiece by means of a first sensor;

terminating the supply of microwaves at substantially maximum power when the sensed humidity reaches a predetermined first humidity value (H1) indicating the entering into a reliable boiling condition; and thereafter supplying microwaves at a power level less than the maximum power during a second sensor controlled heating step, during which a desirable degree of simmering or boiling is maintained during the boiling time dependent on feed-back information, the second heating step including:

measuring the boiling time, controlling the power level during the second heating step by periodically sensing the humidity and comparing the same with an empirically established humidity value ($H_{cb}$) which corresponds to a desirable degree of simmering/boiling, terminating the second step by interrupting the microwave supply when the boiling time equals the set boiling time ($T_B$) is reached.

2. A method as claimed in claim 1, and further wherein:

the first predetermined value (H1) is greater than the empirically established humidity value ($H_{cb}$).

3. A method as claimed in claim 1, and further comprising:

interrupting said first heating step if said first predetermined value (H1) has not been obtained within a predetermined time (T1) from start of the supply of microwaves into the cavity.

4. A method as claimed in claim 3, and further comprising:

interrupting said second heating step if the sensed humidity is continuously lower than the empirically established humidity value ($H_{cb}$) and if the difference exceeds a predetermined amount (H2) during a predetermined time interval (T3).

5. A method as claimed in claim 1, wherein the first and second sensors are humidity sensors which have been provided for periodically sensing the humidity of the ventilation air from the cavity, and the sensed humidity being based on a moving humidity average ($HUM_{av}$) which is calculated based on a predetermined number of the most recently sensed air humidity values.

6. A method as claimed in claim 5, wherein one and the same humidity sensor is used as the first and second humidity sensors.

7. A method as claimed in claim 5, wherein the microwaves are supplied cyclically and the microwave power level being controlled by means of a power average during each cycle ($T_c$) which is generated by switching on/off the microwave source, and maintaining, increasing or decreasing the power level by giving the switch-on time ($t_{on}$) during the cycle the value of zero, keeping it unchanged, increasing or decreasing the same by defined steps dependent on the value of the difference ($HUM_{err}$) between the humidity average ($HUM_{av}$) which has been calculated for the cycle and the empirically established humidity value ($H_{cb}$) as compared with fixed difference limits (C1–C5).

8. A microwave oven comprising an oven cavity, a microwave source, a supply system for supplying microwaves into said cavity, a program-controlled micro-processor control unit for controlling power level and supply time of the microwaves being supplied to the cavity, and operation means connected to said control unit for setting a boiling time of a solid or liquid type of foodpiece, the microwave oven comprising:

a first means for rapidly heating the foodpiece into boiling during a first heating period, the first means operates to energize the microwave supply system such that the cavity is supplied at maximum or substantially maximum power;

a first humidity sensor for sensing the air humidity of the ventilation air from the cavity and being connected to the control unit;

means for interrupting the power supply at a moment when a predetermined humidity value (H1) is sensed by the first humidity sensor;

a second humidity sensor for sensing the air humidity of the ventilation air from the cavity and being connected to the control unit;

a second means for maintaining a boiling condition during a second heating period after boiling is initially established wherein the supplied microwave power level is controlled dependent on feedback humidity information from the second humidity sensor in order to maintain an empirically established humidity value ($H_{cb}$) which corresponds to a desirable degree of boiling during a boiling time ($T_b$) which has been set for the foodpiece, the second means energizes the microwave supply system by setting the power level at a predetermined start value and by starting a count-down of the boiling time ($T_b$).

9. A microwave oven as claimed in claim 8, wherein one and the same humidity sensor is provided for the first and second humidity sensors.

10. A microwave oven as claimed in claim 8, wherein the microprocessor control unit is programmed to interrupt the first heating period if the predetermined humidity value (H1) is not reached within a predetermined maximum period of time (T1).

11. A microwave oven as claimed in claim 8, wherein the microprocessor control unit is programmed to interrupt the second heating period if the air humidity which is sensed during a predetermined amount of time (T3) is continuously lower than said empirically established humidity value ($T_{cb}$) and said difference exceeds a predetermined amount (H2).

12. A microwave oven as claimed in claim 8, wherein the microprocessor control unit is programmed for receiving humidity values periodically, calculating, for each humidity value that has been received, a moving humidity average ($HUM_{av}$) based on a predetermined number of values which have been received most recently, and controlling the microwave source dependent on the humidity averages calculated in this manner.

13. A microwave oven as claimed in claim 12, wherein said microwaves being supplied by switching on/off the microwave source during power cycles ($T_c$) and a desirable power level being generated as a power average by controlling the switch-on time ($t_{on}$) during a respective cycle, and the microprocessor control unit is programmed to decrease or increase the switch-on time ($t_{on}$) by defined steps (0,2s; 0,6s) during a power cycle ($T_c$), alternatively maintaining a current switch-on time, dependent on whether the difference ($HUM_{err}$) between the calculated humidity average ($HUM_{av}$) and the empirically established humidity value ($H_{cb}$) exceeds or is lower than values, respectively stays within value intervals defined by a selected set of fixed difference value limits (C1–C5).

14. A microwave oven as claimed in claim 13, wherein the microprocessor control unit is arranged to operate by five difference value limits (C1–C5), in which the microwave source is not activated during the cycle if said difference exceeds a first difference value limit (C1), the switch-on time ($t_{on}$) is increased by a first step (0,2 s) if said difference is negative and stays within an interval defined by a second (C2) a third (C3) difference value limit, the switch-on time ($t_{on}$) is increased by a second step (0,6 s) if said difference is negative and exceeds said third difference value limit (C3), the switch-on time ($t_{on}$) is decreased by said first step (0,2 s) if said difference ($HUM_{err}$) is positive and stays within an interval defined by a fourth (C4) and a fifth (C5) difference value limit, the switch-on time ($t_{on}$) is decreased by said second step (0,6 s) if said difference ($HUM_{err}$) is positive and larger than said first (C1) or fifth (C5) difference value limit, the switch-on time ($t_{on}$) is kept unchanged if the calculated air humidity average ($HUM_{av}$) stays in the neighbourhood of said empirically established value ($H_{cb}$) and within an interval defined by said second (C2) and fourth (C4) value limits.

15. A microwave oven as claimed in claim 14, wherein said power cycle having a length of substantially 20s, said first and second defined steps have a length of 0,2s respectively 0,6s, a current air humidity is calculated with a periodicity of 1s, and the calculation of said air humidity average is based on a number of 20 of the humidity values most recently received.

16. A microwave oven as claimed in claim 8, wherein the start value of the power level at the beginning of is substantially 30% of maximum power.

17. A microwave oven as claimed in claim 8, wherein the oven comprises an audio signal source, being arranged so as to be activated at the end of the procedure after count-down to zero of the boiling time, alternatively also when the procedure is interrupted of other reasons.

* * * * *